US007716942B2

(12) United States Patent
Choi et al.

(10) Patent No.: US 7,716,942 B2
(45) Date of Patent: May 18, 2010

(54) SERVICE VALVE ASSEMBLY AND AIR CONDITIONER HAVING THE SAME

(75) Inventors: Sung-Oh Choi, Gyeonggi-Do (KR); Si-Kyong Sung, Seoul (KR); Ki-Bum Kim, Seoul (KR); Jin-Ha Choi, Gyeonggi-Do (KR); Jae-Sik Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 912 days.

(21) Appl. No.: 11/349,893

(22) Filed: Feb. 9, 2006

(65) Prior Publication Data

US 2006/0179864 A1 Aug. 17, 2006

(30) Foreign Application Priority Data

Feb. 16, 2005 (KR) ..... 10-2005-0012847

(51) Int. Cl.
*F25B 45/00* (2006.01)

(52) U.S. Cl. ..... 62/292; 62/475

(58) Field of Classification Search ..... 62/292, 62/77, 149, 475

See application file for complete search history.

(56) References Cited

U.S. PATENT DOCUMENTS 3,785,163 A * 1/1974 Wagner ..... 62/77
4,109,536 A * 8/1978 Strybel ..... 73/756
4,324,270 A * 4/1982 Mullins ..... 137/317
5,787,929 A * 8/1998 Iwata ..... 137/625.43
6,041,818 A * 3/2000 Schadewald et al. ... 137/614.19
6,338,255 B1 * 1/2002 Richard et al. ..... 62/292
6,425,571 B1 * 7/2002 Schadewald et al. ... 251/315.13
6,484,526 B2 * 11/2002 Terry ..... 62/292
7,051,996 B2 * 5/2006 Grau ..... 251/309
2004/0182455 A1 9/2004 Wells et al.

FOREIGN PATENT DOCUMENTS

CN 1532439 9/2004
JP 11148749 6/1999
KR 0033832 2/1987

OTHER PUBLICATIONS

English language Abstract of JP 11-148749.

* cited by examiner

*Primary Examiner*—Melvin Jones
(74) *Attorney, Agent, or Firm*—KED & Associates, LLP

(57) ABSTRACT

An air conditioner having a service valve assembly which comprises a connection body connected with a refrigerant pipe through which a refrigerant flows, and having a penetration passage through which the refrigerant flows; an opening/closing unit disposed in the connection body, and having a blocking hole for opening/closing the passage of the refrigerant flowing through the penetration passage; a plurality of ports disposed at the connection body, respectively, by a particular interval therebetween, connected with the penetration passage, and having an opened end portion, respectively; and a filter unit removably coupled to each end portion of the ports such that the refrigerant flowing through the penetration passage is bypassed to the ports to thus be filtered thereby, whereby it is possible to basically solve the problem in a blocking caused by moisture and foreign materials within a circulation system of the air conditioner, and to simplify the construction of the system by being provided with a filter and a drier which are removable.

10 Claims, 7 Drawing Sheets

SERVICE VALVE ASSEMBLY AND AIR CONDITIONER HAVING THE SAME

BACKGROUND OF THE INVENTION

1. Field of the Invention

The present invention relates to an air conditioner, and particularly, to a service valve assembly and an air conditioner having the same capable of decreasing a flow passage resistance of a refrigerant and simplifying the construction of the air conditioner by coupling an outer filter drier to the air conditioner at the time of installation thereof or after-sales service therefor, filtering foreign materials such as moisture, welding oxide, or the like in a refrigerant pipe, and separating the filter drier from the air conditioner after completing the operation.

2. Background of the Related Art

In general, an air conditioner is used to maintain temperature, humidity, cleanliness, or the like to be appropriate for the use of areas, and to eliminate dust or harmful gas. For using it as a cooling apparatus, the air conditioner forms a cycle of absorbing indoor heat to maintain the inside at a low temperature, and then discharging the absorbed heat to the exterior.

As an example of the air conditioner, a multi-air conditioner, as shown in FIG. 1, comprises an outdoor unit 10 including a compressor 12 and an outdoor heat exchanger 14, an indoor unit 30 including an indoor heat exchanger 31 disposed at each indoor space, and a distributing unit 20 including distribution valves 21 and 22 for connecting or blocking a passage between each indoor heat exchanger 31 and the outdoor unit 10.

An operational principle of the multi-air conditioner will now be explained hereafter. In case of a complete cooling operation for operating every indoor unit in a cooling mode, the indoor heat exchanger 31 functions as an evaporator, and the outdoor heat exchanger 14 functions as a condenser. A refrigerant sequentially passes through the compressor 12, a four-way valve 13 and the outdoor heat exchanger 14 of the outdoor unit 10. The refrigerant then passes through an expansion valve 32 and the indoor heat exchanger 31 in each indoor unit 30 along a liquid line. Thereafter, the refrigerant is retrieved into an accumulator 11 along a low pressure vapor line 25. The refrigerant is then divided into vapor and liquid to be delivered to the compressor 12.

In case of a complete heating operation for operating every indoor unit in a heating mode, on the other hand, the indoor heat exchanger 31 functions as the condenser, and the outdoor heat exchanger 14 functions as the evaporator. The refrigerant passes through the compressor 12 along a high pressure vapor line 24 and is heat-exchanged in the indoor heat exchanger 14. The refrigerant then passes through an expansion valve 15, the indoor heat exchanger 14 and the four-way valve 13 along the liquid line 23 to be retrieved into the accumulator 11. The refrigerant is then delivered to the compressor 12 again.

In the multi-air conditioner having such construction and principle, after the installation or repair service thereof, upon operating the multi-air conditioner, the refrigerant starts to circulate. Here, foreign materials such as moisture, welding oxide or the like within each connected refrigerant pipe circulate within the multi-air conditioner together with the refrigerant, and thereby are accumulated in the compressor 12 or the expansion valves 15 and 32. In order to prevent the accumulation of the foreign materials, a filter (strainer) 18 is disposed at an upstream side of the compressor 12, based upon the flow of the refrigerant, and a similar apparatus (not shown) thereto is disposed at an upstream side of the expansion valves 15 and 32.

While driving the multi-air conditioner having such construction, the filter 18 is continuously mounted at a circulating system of the refrigerant. Accordingly, foreign materials accumulated in the filter 18 increase a flow passage resistance due to the refrigerant being circulated, which causes a freezing of the refrigerant, thereby decreasing the performance of the multi-air conditioner.

In order to reduce a mechanical friction of the compressor 12 and prevent the generation of heat, on the other hand, lubricating oil is mixed with the refrigerant for use. While performing a vacuum operation, if moisture contained in the refrigerant is not completely removed, the moisture is absorbed by the refrigerant and the lubricating oil to thereafter be an icy grain, which then causes various mechanical problems. Accordingly, a drier 17 is mounted in parallel in the liquid line 23 in order to completely remove the moisture contained in the refrigerant and the lubricating oil being circulated.

The drier 17 does not have to be continuously disposed in the multi-air conditioner as the apparatus for removing the moisture after installing the multi-air conditioner or after-sales services. For being continuously mounted, deterioration of the drier 17 may cause a decrease in performance of the multi-air conditioner and the construction of the multi-air conditioner system may be complicated.

BRIEF DESCRIPTION OF THE INVENTION

Therefore, an object of the present invention is directed to basically solving a problem in a blocking of a circulating system of an air conditioner due to moisture and foreign materials, and a simplifying a construction of the system by providing a filter and a drier which are removable.

To achieve these and other advantages and in accordance with the purpose of the present invention, as embodied and broadly described herein, there is provided an air conditioner having a service valve assembly which comprises: a connection body connected with a refrigerant pipe of a refrigerant circuit and having a penetration passage through which the refrigerant flows; a opening/closing unit provided at the connection body and having a blocking hole for opening/closing the passage of the refrigerant flowing through the penetration passage; a plurality of ports disposed at the connection body, respectively, by a particular interval therebetween, connected with the penetration passage, and having an opened end portion, respectively; and a filter unit removably coupled to each end portion of the ports such that the refrigerant flowing through the penetration passage is bypassed to the ports to be then filtered thereby.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

A service valve assembly according to the present invention is related to a technique in which a plurality of ports are provided at a connection body which is connected with a refrigerant pipe of a refrigerant circuit, and the ports provide passages through which the refrigerant is bypassed to an external apparatus and then re-introduced.

Also, the present invention provides an air conditioner having a service valve assembly having a plurality of ports at a connection body which is connected to a refrigerant pipe of a refrigerant circuit, and a filter unit removably connected with the ports, respectively, thereby filtering moisture and foreign materials within the refrigerant pipe.

Hereinafter, the service valve assembly and an air conditioner having the same in accordance with embodiments of the present invention will now be explained in detail with reference to attached drawings, and a detailed explanation with respect to related functions or components will be omitted.

Figure 1:
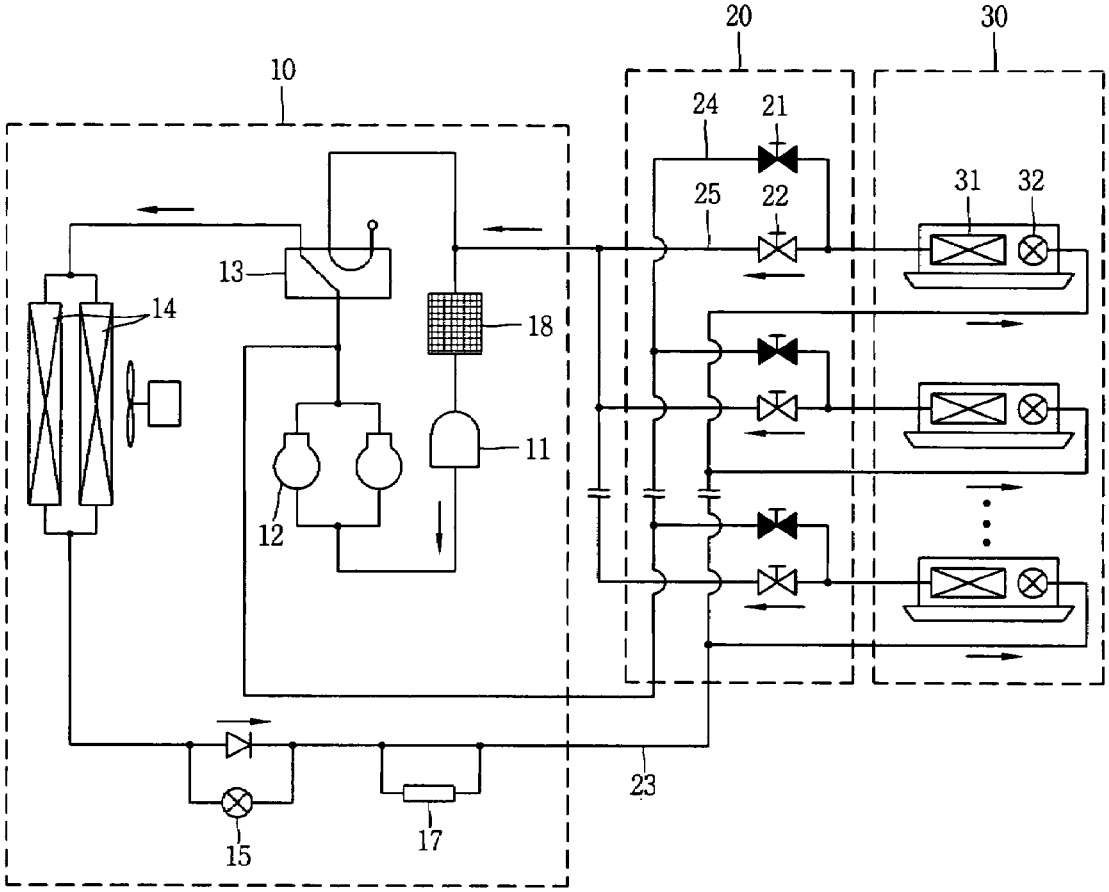
FIG. 1 CONVENTIONAL ART
FIG. 1 is a view illustrating a construction of a multi-air conditioner system of the related art.
Figure 2:
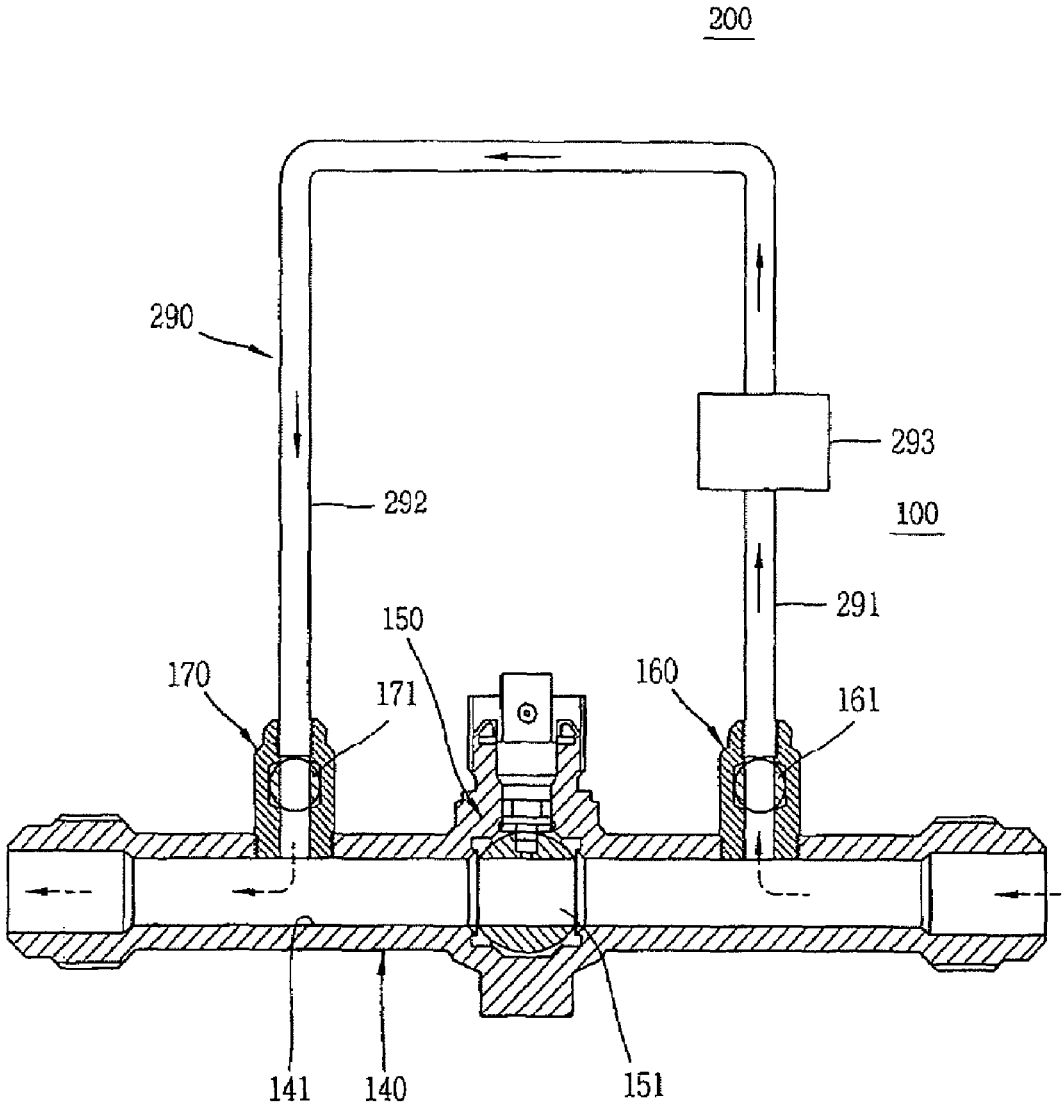
FIG. 2 is a horizontal sectional view illustrating a service valve assembly in accordance with an embodiment of the present invention.

FIG. 2 is a horizontal sectional view illustrating a service valve assembly in accordance with an embodiment of the present invention. As illustrated therein, a service value assembly 100 according to the present invention comprises a connection body 140 disposed to be connected with a refrigerant pipe (not shown) of a refrigerant circuit and having a penetration passage 141 through which the refrigerant flows, an opening/closing unit 150 provided at the connection body 140 and having a blocking hole 151 for opening/closing the passage of the refrigerant flowing through the penetration passage 141, and a plurality of ports disposed at the connection body 140, respectively, by a particular interval therebetween, connected with the penetration passage 141, and each of which has an opened end portion to allow an external apparatus (not shown) to be removable therefrom.

The ports preferably include a first port 160 for providing a passage so that the refrigerant flowing along the penetration passage 141 of the connection body 140 can be introduced therein, and a second port 170 for providing a passage so that the refrigerant containing moisture and foreign materials can be bypassed to the external apparatus to thereafter be discharged therethrough. The first and second ports 160 and 170 are removable from the connection body 140, respectively.

The ports 160 and 170 have valves 161 and 171, respectively, for opening/closing the passage for the refrigerant therein. The passage is opened or blocked by opening or closing the valves 161 and 171.

The valves 161 and 171 may be disposed in various forms if they can open or block the passage of the refrigerant flowing along the ports 160 and 170.

A blocking hole 151 for opening/closing the passage of the refrigerant is provided at the center of the opening/closing unit 150. Accordingly, it is possible to open or block the passage for the refrigerant by opening/closing the blocking hole 151. The blocking hole 151 can also be disposed in various forms for opening/closing the passage.

In the service valve assembly having such construction, the external apparatus (not shown) is connected with the first port 160 and the second port 170, respectively, to bypass the refrigerant thereto. The end portions of each of the first and second ports 160 and 170 are opened to thus facilitate the removing of the external apparatus.

Figure 3:
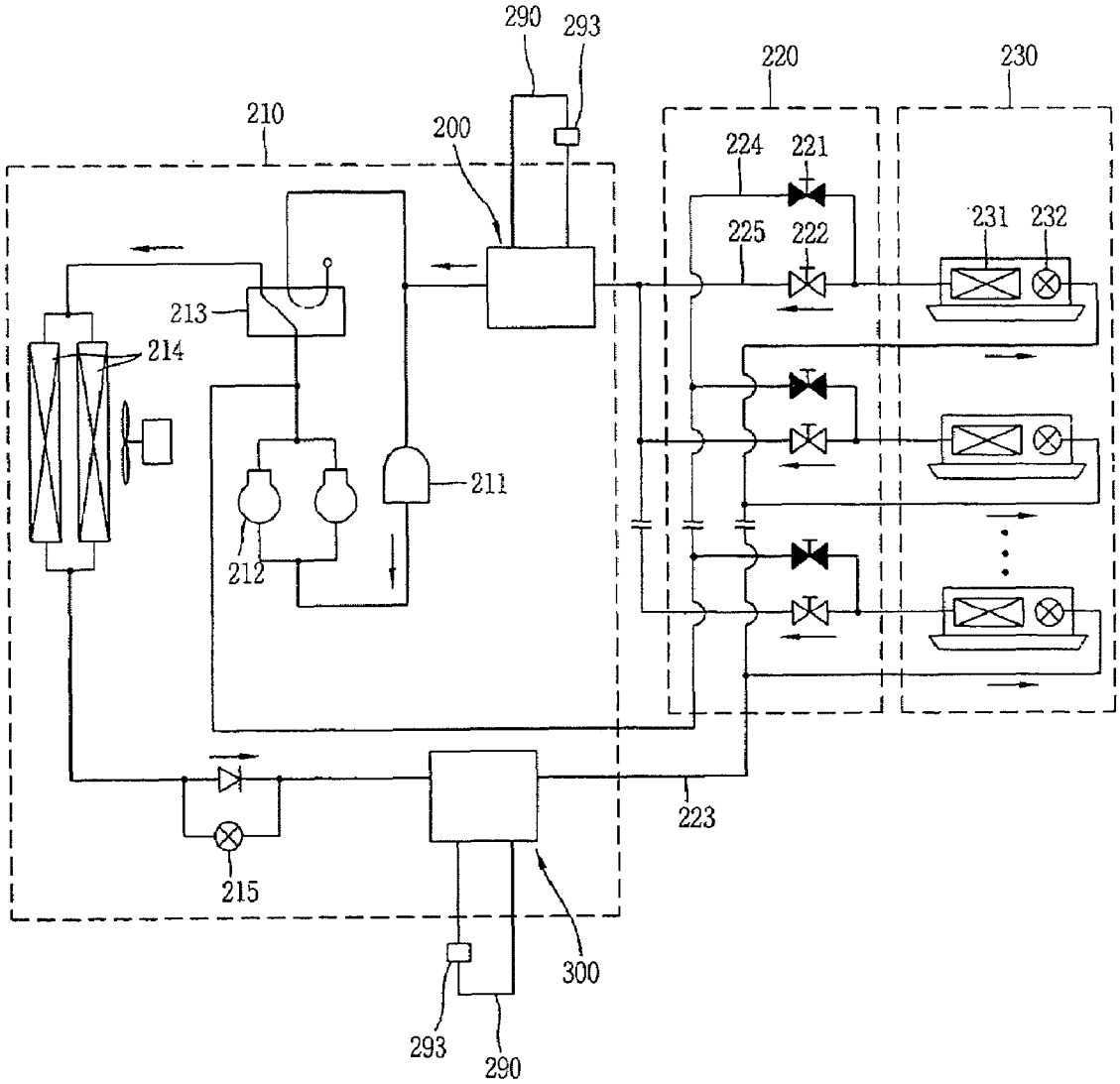
FIG. 3 is a view illustrating a construction of an air conditioner system having a service valve assembly according to the present invention.

FIG. 3 is a view illustrating a construction of an air conditioner system having the service valve assembly according to the present invention. The explanation for the same construction as that of the related art will be omitted. As illustrated in FIG. 3, a multi-air conditioner having a service valve assembly according to the present invention includes an outdoor unit 210 having an accumulator 211, a compressor 212, a four-way valve 213, an outdoor heat exchanger 214 and an expansion valve 215, an indoor unit 230 having an indoor heat exchanger 231 and an expansion valve 232 installed at each indoor area; and a distributing unit 220 including distribution valves 221 and 222 for connecting or blocking a passage of each refrigerant pipe 223, 224 and 225 between each indoor heat exchanger 231 and the outdoor unit 210. Service valve assemblies 200 and 300 are disposed at each refrigerant pipe 225 and 223 at the side of the outdoor unit 210.

Figure 4:
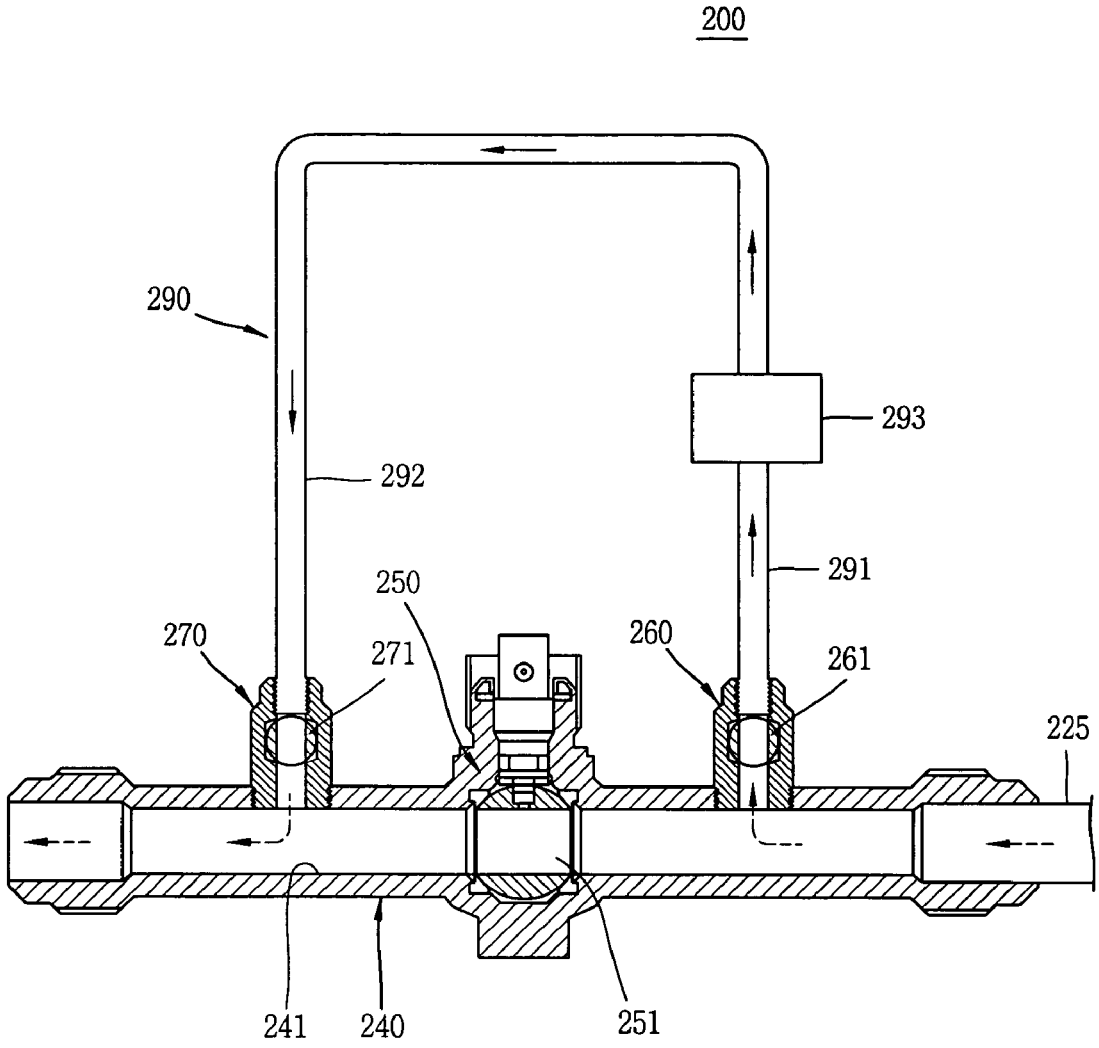
FIG. 4 is an enlarged sectional view illustrating a service valve assembly at a side of a low pressure vapor line.

FIG. 4 is an enlarged sectional view illustrating a service valve assembly at a side of a low pressure vapor line. As illustrated therein, the service valve assembly 200 includes a connection body 240 connected with a refrigerant pipe 225 through which the refrigerant flows, and having a penetration passage 241 through which the refrigerant flows, an opening/closing unit 250 disposed at the connection body 240 and having a locking blocking hole 251 for opening and blocking the passage for the refrigerant flowing along the penetration passage 241; a plurality of ports 260 and 270 disposed at the connection body 240, respectively, by a particular interval therebetween, and having an opened end portion, respectively; and a filter unit 290 removably coupled to each end portion of the ports 260 and 270 such that the refrigerant flowing along the penetration passage 241 is bypassed to the ports 260 and 270 to be then filtered thereby.

The connection body 240 is connected with the refrigerant pipe 225 at the side of the low pressure vapor line through which the refrigerant flows, and has the penetration passage 241 through which the refrigerant can then flow.

The ports 260 and 270 include a first port 260 for providing a passage so that the refrigerant flowing in the connection body 240 can be introduced therein, and a second port 270 for providing a passage so that the refrigerant containing moisture and foreign materials is filtered by the filter unit 290 and the filtered refrigerant can then be discharged therethrough. The end portions of the ports 260 and 270 are opened, and thus the ports 260 and 270 can be attached to or removed from the connection body 240 and the filter unit 290 can also be attached to or removed from the ports 260 and 270.

The ports 260 and 270 have valves 261 and 271 therein for opening/closing the refrigerant passage. By opening/closing the valves 261 and 271, the passage can be opened or blocked.

The valves 261 and 271 can be disposed in various forms if they can open or block the passage within the ports 260 and 270.

A blocking hole 251 for opening/closing the refrigerant passage can be provided at the center of the opening/closing unit 250. Accordingly, it is possible to open or block the refrigerant passage by opening/closing the blocking hole 251.

The blocking hole 251 can also be disposed in various forms for opening/closing the passage.

The filter unit 290 includes a first connection pipe 291 removably connected with the end portion of the first port 260 such that the refrigerant introduced into the first port 260 can flow therethrough; a filter drier 293 disposed at the first connection pipe 291 for filtering moisture and foreign materials from the refrigerant flowing through the first connection pipe 291; and a second connection pipe 292 removably connected with the end portion of the second port 270 such that the refrigerant can flow to be discharged outwardly therethrough.

Figure 5:
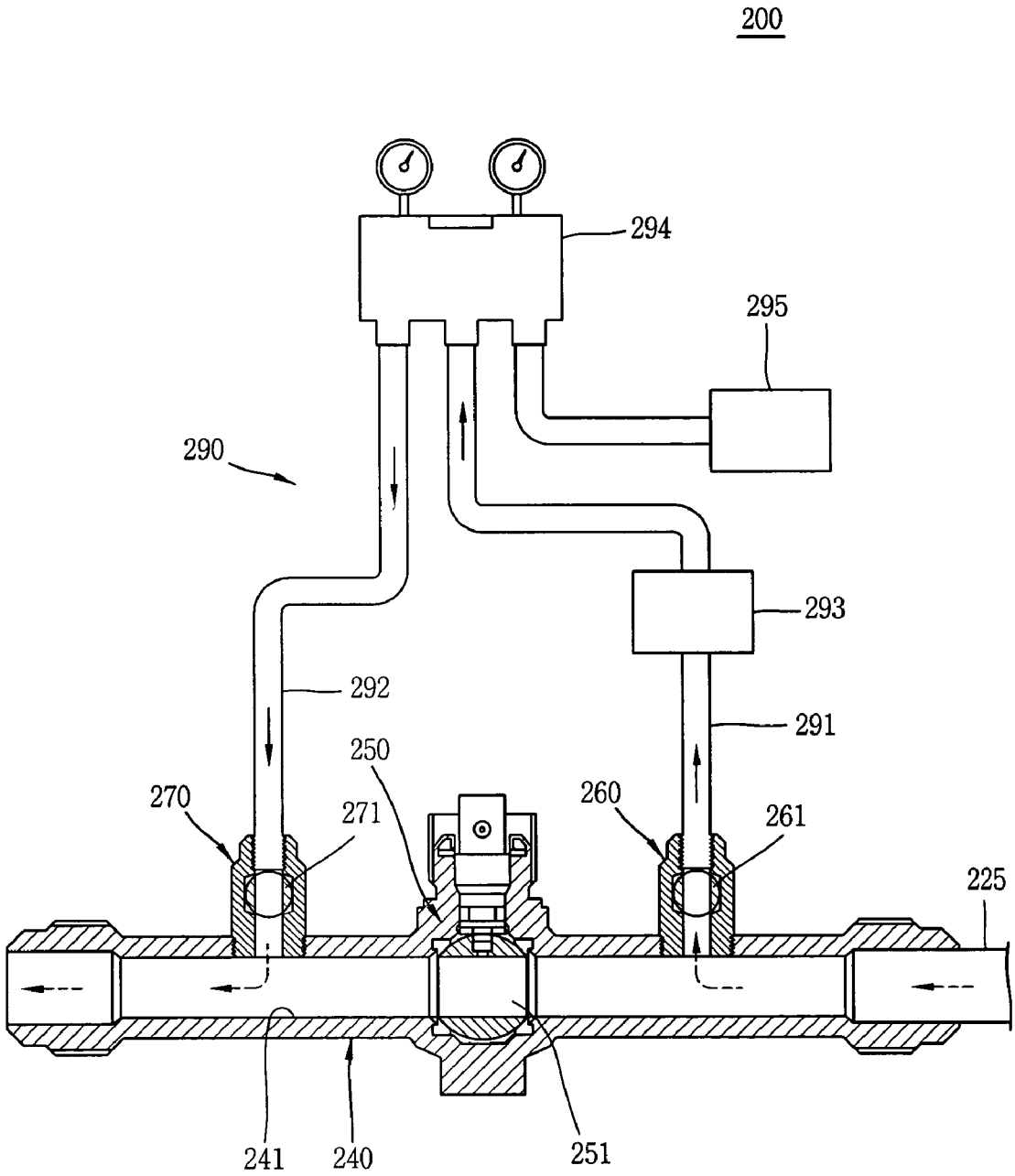
FIG. 5 is an enlarged sectional view illustrating a varied embodiment of FIG. 4.

The filter unit 290 has been provided with the first connection pipe 291, the filter drier 293 and the second connection pipe 292. However, as shown in FIG. 5, which shows a varied embodiment of the present invention, the filter unit 290 may further include a manifold gauge 294 and a vacuum pump 295 provided for injecting the refrigerant and measuring pressure.

Figure 6:
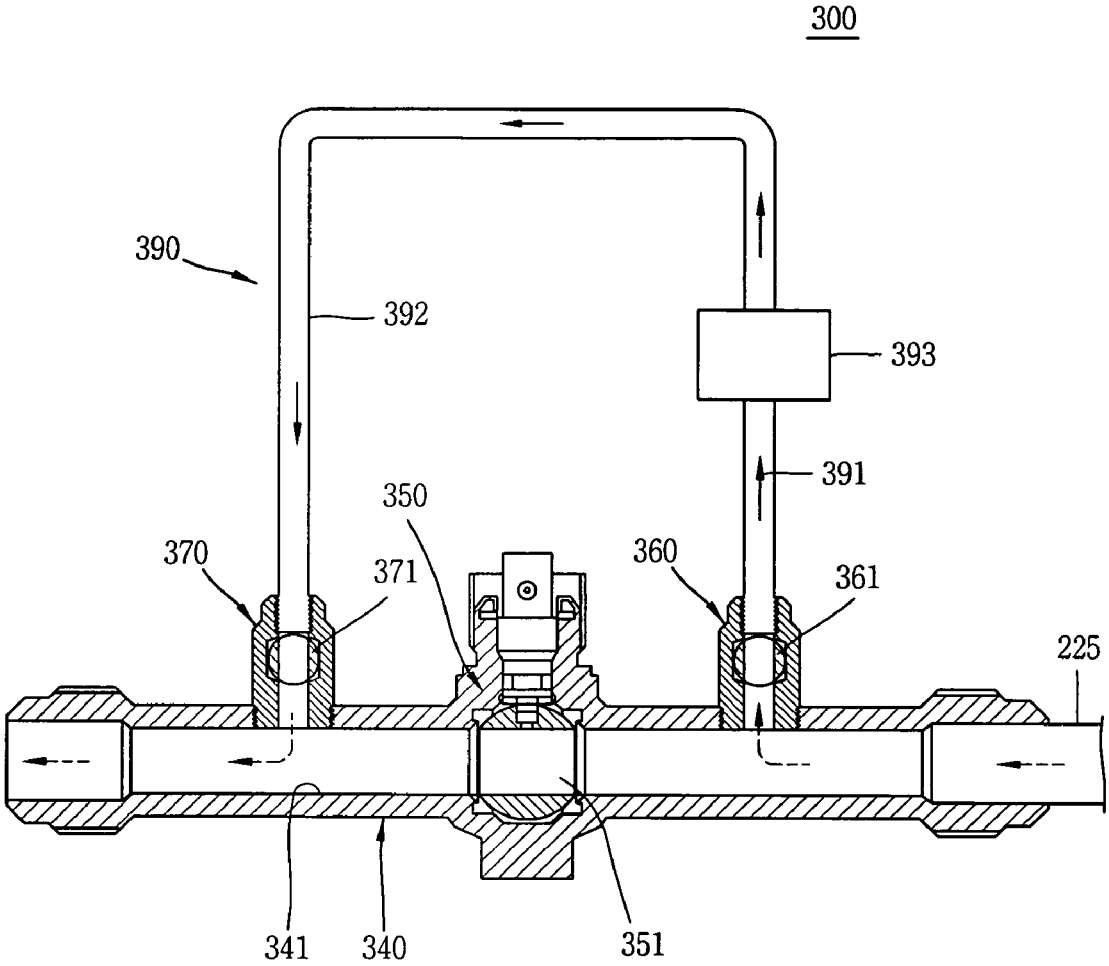
FIG. 6 is an enlarged sectional view illustrating a service valve assembly at a side of a liquid line.
Figure 7:
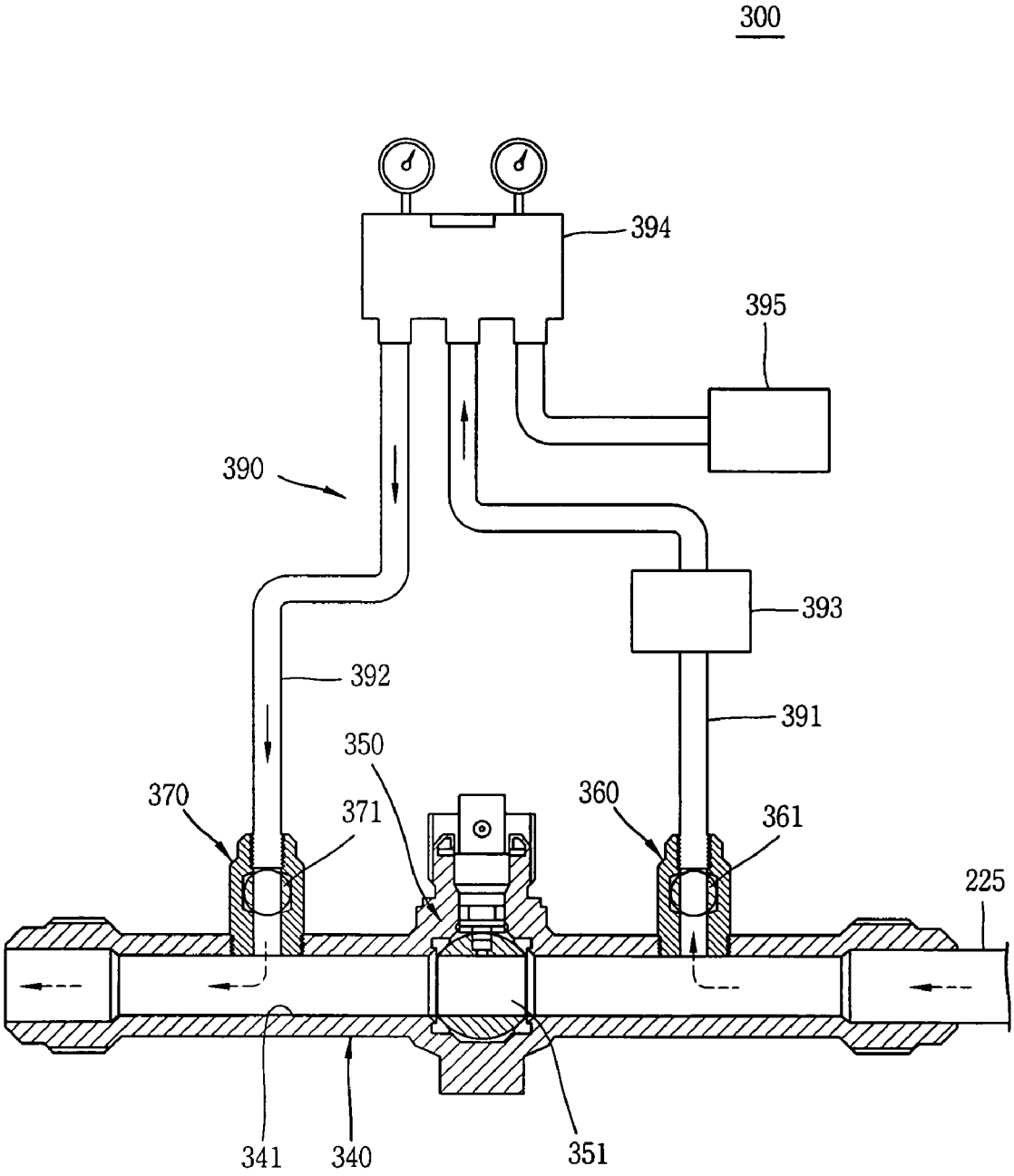
FIG. 7 is an enlarged sectional view illustrating a varied embodiment of FIG. 6.

A structure of the service valve assembly provided at the side of the low pressure vapor line and functions thereof have been explained. However, as illustrated in FIGS. 6 and 7, a service valve assembly having the same functions is also provided at the side of the liquid line, for which detailed explanation will thus be omitted.

A procedure for removing moisture and foreign materials in the air conditioner having the service valve assembly according to the present invention having such construction will now be explained with reference to FIGS. 3, 5 and 7.

In the service valve assembly installed in each refrigerant pipe 223 and 225 of the low pressure vapor line and the liquid line, the first connection pipe 291 and 391 and the second connection pipe 292 and 392 of the filter unit 290 and 390 are connected, respectively, with the first port 260 and 360 and the second port 270 and 370, thereby constructing a passage. Here, the filter unit 290 and 390 may be disposed such that the refrigerant flowing out of the indoor unit 230 and the distributing unit 220 can pass through the filter drier 293 and 393 of the filter unit 290 and 390.

Next, the vacuum pump 295 and 395 provided at the manifold gauge 294 and 394 is used to vacuumize each refrigerant pipe 223 and 225 and to charge the refrigerant.

Afterwards, in the service valve assembly 200 installed in the refrigerant pipe 225 at the side of the low pressure vapor line, the blocking hole 251 provided at the opening/closing unit 250 is closed, and the manifold gauge 294 provided at the filter unit 290 and the valves 261 and 271 of the ports 260 and 270 are opened. Accordingly, the air conditioner is operated in a cooling mode for a particular time duration. According to the cooling operation, the refrigerant is introduced into the first port 260 and filtered by the filter drier 293 to thereafter be discharged outwardly through the second port 270. Accordingly, the moisture and foreign materials contained in the refrigerant within the low pressure vapor line can be removed.

Thereafter, the manifold gauge 294 and the valves 261 and 271 of the ports 260 and 270 are closed, and the blocking hole 251 of the opening/closing unit 250 is opened. Then, the filter unit 290 of the service valve assembly 200 is removed (separated) from the refrigerant pipe 225.

In the service valve assembly 300 installed at the refrigerant pipe 223 at the side of the liquid line, in addition, the blocking hole 351 provided at the opening/closing unit 350 is closed and the manifold gauge provided at the filter unit 390 and the valves 361 and 371 of the ports 360 and 370 are opened. Accordingly, the air conditioner is operated in a heating mode for a particular time duration. According to the heating operating, the refrigerant is introduced into the first port 360 and filtered by the filter drier 393, to thereafter be discharged outwardly through the second port 370. Accordingly, the moisture and foreign materials contained in the refrigerant within the liquid line can completely be removed.

Finally, the manifold gauge 394 of the filter unit 390 and the valves 361 and 371 of the ports 360 and 370 are closed and the blocking hole 351 of the opening/closing unit 350 is opened. Thereafter, the filter unit 390 of the service valve assembly 300 is removed (separated) from the refrigerant pipe 223, thereby completing the operation.

As aforementioned, after an installation of the air conditioner or after-sales services therefor, the service valve assembly is preferably disposed at both the low pressure vapor line and the liquid line of a circulation system of the refrigerant to thus perform the removing of moisture and foreign materials from the refrigerant. Also, it is also possible to install the service valve assembly according to the present invention at any one of the low pressure vapor line or the liquid line to perform the removing thereof.

In addition, the service valve assembly is sequentially disposed at the low pressure vapor line and the liquid line in series, and then the refrigerant is bypassed only to the first port to thus perform a vacuum operation for the refrigerant or charging operation therefor. In another case, the refrigerant is bypassed to both the first and second ports at the same time to thus remove the moisture and foreign materials from the refrigerant.

Even for the air conditioner which is usually used in a cooling mode, the service valve assembly according to the present invention is installed at any one of the low pressure vapor line and the liquid line or at both the low pressure vapor line and the liquid line at the same time, and it is accordingly possible to remove the moisture and foreign materials through the filter unit.

In the air conditioner having such service valve assembly, the filter drier can be removed from the refrigerant passage, by which the flow passage resistance due to the moisture and foreign materials filtered by the filter drier may not basically be generated. A simple construction of the air conditioner can also be expected. In addition, while performing after-sales services for the air conditioner such as replacing the refrigerant or the like, the refrigerant can easily be processed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A service valve assembly, comprising:

a connection body connected with a refrigerant pipe of a refrigerant circuit, and having a penetration passage through which the refrigerant flows;

an opening/closing device disposed in the connection body that opens and closes the passage of the refrigerant flowing along the penetration passage; and a plurality of ports disposed at the connection body, connected with the penetration passage, and each having an open end portion to attach or remove an external apparatus thereto or therefrom, wherein the plurality of ports is connected to each other so as to bypass the refrigerant via the external apparatus attached thereto while the opening/closing device closes the penetration passage, and wherein the plurality of ports comprises:

a first port that provides a passage such that the refrigerant flowing in the connection body is introduced therein; and a second port that provides a passage such that the refrigerant containing moisture and foreign materials is bypassed to the external apparatus to be then discharged therethrough.

2. The assembly of claim 1, wherein the plurality of port is attachable to and removable from the connection body.

3. The assembly of claim 1, wherein the plurality of ports each includes a valve therein that opens and closes the passage of the refrigerant.

4. An air conditioner having a service valve assembly, the air conditioner comprises:

a connection body installed over an indoor device and an outdoor device, connected with a refrigerant pipe through which a refrigerant flows, and having a penetration passage through which the refrigerant flows;

an opening/closing device disposed in the connection body, and having a blocking hole that opens and closes the passage of the refrigerant flowing through the penetration passage;

a plurality of ports disposed at the connection body with a particular interval therebetween, connected with the penetration passage, and each having an open end portion; and a filter device removably coupled to the open end portion of each of the plurality of ports, such that the refrigerant flowing through the penetration passage is bypassed to the plurality of ports to be filtered by the filter device, wherein the plurality of ports is connected to each other so as to bypass the refrigerant via the filter device attached thereto while the opening/closing device closes the penetration passage, and wherein the plurality of ports includes:

a first port that provides a passage such that the refrigerant flowing in the connection body is introduced therein; and a second port that provides a passage such that the refrigerant containing moisture and foreign materials is filtered by the filter device to be then discharged therethrough.

5. The air conditioner of claim 4, wherein the plurality of ports are attachable to and removable from the connection body.

6. The air conditioner of claim 4, wherein the plurality of ports each includes a valve therein that opens and closes the passage of the refrigerant.

7. The air conditioner of claim 4, wherein the filter device includes:

a first connection pipe removably connected with the open end portion of the first port, such that the refrigerant introduced into the first port flows therethrough;

a filter drier disposed at the first connection pipe that filters moisture and foreign materials from the refrigerant flowing through the first connection pipe; and a second connection pipe removably connected with the open end portion of the second port, such that the refrigerant from which the moisture and foreign materials are filtered by the filter drier is discharged outwardly through the second port.

8. The air conditioner of claim 4, wherein the filter device includes a manifold gauge that injects the refrigerant and measures a pressure of the refrigerant.

9. The air conditioner of claim 4, wherein the filter device includes a vacuum pump.

10. The air conditioner of claim 4, wherein the service valve assembly is connected with one of a liquid line that provides a passage through which a liquid refrigerant flows and a vapor line that provides a passage through which a gaseous refrigerant flows, or is connected with both the liquid line and the vapor line.

* * * * *